US005150800A

United States Patent [19]

Sarter et al.

[11] Patent Number: 5,150,800

[45] Date of Patent: Sep. 29, 1992

[54] TRAINING CAP FOR NURSING BOTTLES

[76] Inventors: Celia Sarter; Rick Sarter, both of 24 R St., NE., Washington, D.C. 20002

[21] Appl. No.: 635,390

[22] Filed: Jan. 2, 1991

Related U.S. Application Data

[63] Continuation of Ser. No. 362,868, Jun. 7, 1989, abandoned.

[51] Int. Cl.[5] ..... A61J 9/00; A61J 11/04

[52] U.S. Cl. ..... 215/11.4; 215/11.1

[58] Field of Search ..... 215/11.1–11.6; D24/45, 46; 220/90.2

[56] References Cited

U.S. PATENT DOCUMENTS

| | | | |
|---|---|---|---|
| D. 179,215 | 11/1956 | Prisament | D24/46 |
| D. 299,064 | 12/1988 | Berndt | D24/45 X |
| 2,372,281 | 3/1945 | Jordan | 215/11.1 X |
| 2,569,139 | 9/1951 | Abelson | 215/11.1 |
| 2,608,841 | 9/1952 | Rice | 215/11.5 X |
| 2,630,118 | 3/1953 | Casey | 215/11.4 |
| 2,699,234 | 2/1954 | Baracate | 215/11.4 |
| 2,745,568 | 5/1956 | Newton | 215/11.4 |
| 3,071,272 | 1/1963 | Doner | 215/11.1 |
| 3,211,315 | 10/1965 | Griesinger | 215/11.1 |
| 3,645,262 | 2/1972 | Harrigan | 215/11.1 X |
| 4,135,513 | 1/1979 | Arisland | 215/11.4 |
| 4,600,111 | 7/1986 | Brown | 215/11.1 X |
| 4,856,995 | 8/1989 | Wagner | 215/11.3 X |

FOREIGN PATENT DOCUMENTS

| | | | |
|---|---|---|---|
| 1189334 | 10/1959 | France | 215/11.1 |

*Primary Examiner*—Sue A. Weaver

*Attorney, Agent, or Firm*—Ronald P. Kananen

[57] ABSTRACT

A weaning member for a nursing bottle for insertion on the top of the nursing bottle adjacent a closing cap so that a weaning spout of the weaning member extends from the closing cap. The weaning cap can thus replace a conventional nipple closure for the container. A fluid control member is also provided to control the rate of fluid flow through the weaning spout. The face of the weaning spout can be formed to resemble the face of an animal.

7 Claims, 1 Drawing Sheet

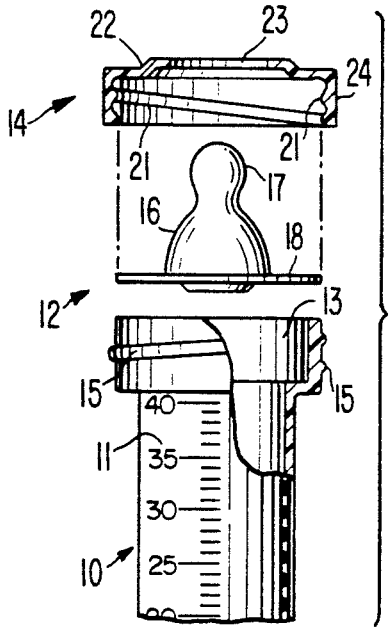
FIG. 1
(PRIOR ART)
FIG. 2
(PRIOR ART)
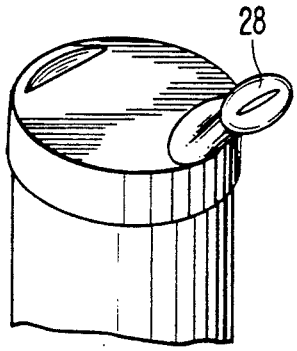
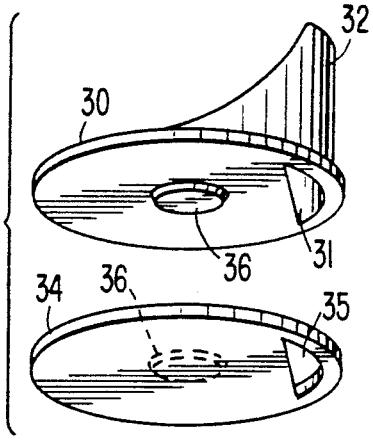
FIG. 4
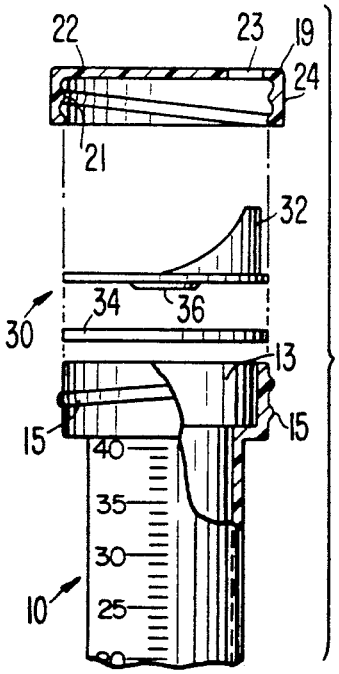
FIG. 3
FIG. 5
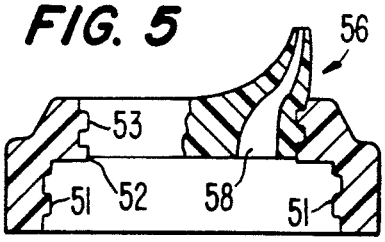
FIG. 6(a)
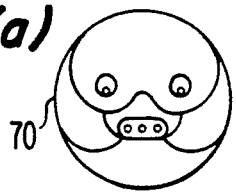
FIG. 6(b)
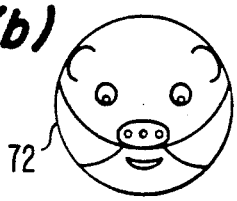
FIG. 6(c)
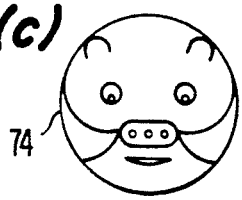

TRAINING CAP FOR NURSING BOTTLES

This application is a continuation of application Ser. No. 07/362,868 filed on Jun. 7, 1989, now abandoned.

BACKGROUND OF THE INVENTION

This invention relates to a training cap for a nursing bottle or other container. More particularly, this invention relates to an insert having a training spout for use with a conventional nursing bottle to adapt the nursing bottle for training. Still more partiuclarly, this invention relates to an improved cap for a nursing bottle for receiving a weaning cap insert with a control disc for controlling the rate of flow of the fluid.

Nursing bottles are well known in the art for dispensing a predetermined formula to an infant. Usually, such bottles incude a bottle portion having an externally-threaded upper portion for receiving an internally-threaded cap. The internally-threaded cap is annular in shape defining an opening for receiving a nipple member having a nipple extending through the cap and in fluid communication with the interior of the bottle. The nipple member is sealed against the top of the bottle by rotation of the cap. Heretofore, such bottles have not been adapted to provide a weaning insert so that the bottle could be used as a training bottle, in a manner similar to training cups used by babies and small children. An example of a self-righting training cup is shown in U.S. Pat. No. 4,388,996.

A prior effort is known in the art for adapting a weaning cap for nursing bottles, as is shown in U.S. Pat. No. 2,569,139. In that patent, a weaning cap is provided with an internally-threaded annular skirt adapted to cooperate with the threads of the baby bottle. The cap includes an outwardly-extending primary weaning spout or drinking device having a generally oval shape and provided with a bulbous oval lip. Such a device, however, is not well-suited for controlling the rate of flow of liquid to the weaning infant, and is inconvenient to use during that period when the infant is using both a nippled cap and a weaning cap.

Moreover, fluid containers such as small jars of juice and the like, are not readily provided with a training cap. Thus, it is desireable to provide an adapter for a juice bottle to permit its use with a training cap.

According, it is an overall object of this invention to provide an insert for a baby bottle to replace a nipple insert with a weaning insert.

It is another object of this invention to provide a controlled liquid dispenser for a baby-bottle, wherein rotation of the cap controls the rate of flow of the fluid.

It is still another object of this invention to provide a cap for a baby bottle which is internally threaded for attachment to the external threads at the top of a baby bottle and either internally or externally threaded for receiving a weaning cap.

It is still another object of this invention to provide a weaning cap for a baby bottle wherein the face of the cap is fashioned like the face of an animal like a duckie, a piggie, or a bear. Maybe even two duckies, one piggie or one bear, or one duckie, two piggies and one bear.

It is still another general object of this invention to provide a weaning cap for a fluid container, wherein the flow through the cap may be controlled.

These and other objects of this invention will become apparent from the written description of the invention which follows taken in conjunction with the accompanying drawings.

BRIEF SUMMARY OF THE INVENTION

Directed to achieving the objective noted above, and to overcoming the problems of the prior art, the invention relates to an insert having a weaning cap configuration which includes a weaning spout fluid communication with the face of the insert which lies adjacent the interior of a baby bottle or other fluid container. The bottle includes a bottle portion terminating in a cap portion having external threads for receiving the internal threads of a spinner cap. Usually, a nipple insert is received within the spinner cap and when positioned adjacent a lip of the bottle, acts in a sealing relationship therewith when the spinner cap is tightened.

Preferably, a second member is positioned adjacent the weaning cap insert and is relatively rotatable. The second member includes an opening therein for controlling the flow of liquid from the interior through a passage in the spout in the weaning cap, depending on the relative degree of opening remaining after rotation.

In an alternative embodiment, the spinner cap is internally threaded to mate with the threads at the top of the baby bottle of other container, and includes a second set of threads, either internal or external, at an axially outward position for receiving a weaning cap having a nozzle portion if fluid communication with the interior of the bottle. A fluid dispensing control member is located within the cap as previously described. The weaning cap may be sealed when not in use.

These and other features and characteristics of the invention will be seen from a detailed consideration of the written description of the invention which follows, taken with the accompanying drawings.

BRIEF DESCRIPTION OF THE DRAWINGS

In the Drawings:

FIG. 1 is an exploded fragmentary view, partially in section, of an upper portion of a conventional baby bottle, with a spinner cap for securing a nipple member in a fluid dispensing relationship with the interior of the bottle;

FIG. 2 is a partial view of a conventional weaning cap showing a weaning dispenser in a friction-tight relationship with a fluid holding member;

FIG. 3 is a view similar to FIG. 1 showing the weaning insert according to the invention, together with a fluid controlling member;

FIG. 4 shows the weaning insert and the fluid controlling member in a perspective view from below, thus illustrating the rotational relationship between their respective fluid passages;

FIG. 5 is a side cross-sectional view of another embodiment of the training cap according to the invention; and FIGS. 6(*a,b* and *c*) show several alternative animal faces suitable for forming the cap therefrom.

DETAILED DESCRIPTION OF THE PREFERRED EMBODIMENTS

FIG. 1 is an elevational exploded view, partly in section, of an infant feeding unit including a calibrated container 10, a nipple member 12 and a retaining cap 14, as shown in FIG. 1 of U.S. Pat. No. 3,645,262. The container 10 may include a plurality of calibrations 11 for measuring a quantity of formula within the container 10. The container 10 includes a closed end (not shown) and an opening 13 at the top thereof. A plurality of external threads 15 lie adjacent the opening 13 for receiving the interior threads 21 of the spinner cap 14 in a mating and sealing relationship.

For oral feeding of the infant, a flexible nipple 16 is positioned over the opening 13 of the container 10. The flexible nipple 16 has a hollow apertured teat portion 17 and a flange 18 near its lower portion opposite the teat portion 17. The flange is dimensioned to rest on and sealingly engage the opening 13 in the container 10.

The retaining cap 14 is releasably engageable with the container 10 and is used to secure the nipple 16. In the embodiment shown, the cap has a depending skirt 24 with internal threads 21 engageable with the threads 15 on the container 10. The retaining cap 14 further includes an inwardly extending top portion 22 defining an opening 23 therein through which the flexible nipple 16 projects when the retaining cap 14 is affixed to the container 10.

The prior art device of FIG. 1 has not produced a weaning insert, such as in shown in FIG. 2 at the reference numeral 28, to replace the nipple 16 in the member 12. Thus, a significant feature of the invention is shown at the reference numeral 30 in FIG. 3 in the form of a weaning insert for a baby bottle of the type described.

The weaning insert 30 is sized to rest on the top portion 13 of the bottle 10 in the same manner as the nipple insert 12. However, the opening in the cap 22 is sized and located to permit the weaning member or spout 32 to extend therethrough. While the weaning insert 30 can rest on the top of the bottle directly, it is preferred that a fluid dispensing control member 34 be located intermediate the weaning member 30 and the bottle top. As best seen in FIG. 4, therefore, the member 30 includes an opening 31 for accessing fluid and in fluid circuit with an opening passing up through the weaning spout 32. A similar opening 35 is formed in the control member 34 so that when the openings 31 and 35 are in register, a maximum amount of fluid can flow from the container through the weaning member. In a manner similar to a grated cheese dispenser, relative rotation of the members 30 and 34 changes the effective cross-sectional area of the fluid passage so that the flow rate of fluid can be controlled. In a preferred embodiment, the relative rotation can occur by slightly loosening the spinner cap 14; however, in the alternative, the frictional relationship between the member 30 and 34 is such that the alterations may be made while the cap 14 is tight.

A lower surface of the weaning insert may include an axially extending upraised portion 36 for mating with a corresponding depression 37 in an upper surface of the control member 34 to facilitate rotational enagememt.

FIG. 5 shows an alternative embodiment of the invention wherein the cap member 50 is internally threaded at 51 to mate with the external threads of the bottle or other container, such as a juice container. The cap member 50 is further threaded at 52 (either internally as shown or extending on a shoulder) to receive the external threads 53 (or internal threads) of a weaning member 56 having a fluid passage 58. In this embodiment, a control member 60 may be fixed in the cap so that rotation of the weaning member adjusts the fluid flow, or both members can be provided as a unit. For convenience, the weaning member may be removed and a plug member (not shown) inserted therein to seal the bottle or container for later use.

Another feature of the embodiment of FIG. 5 is that the diameter of the cap may be sized to fit on standard size juice bottles or fluid containers in the home. Thus, a commercially-available small jar of apple juice, for example, may have its lid removed and replaced with the weaning cup set of FIG. 5, regardless of the diameter of the bottle. This facilitates use of the training cup on fluid jars.

FIGS. 6 shows a plurality of novelty features for the top view of the weaning insert or member. Thus, in FIG. 6*a*, a duck face 70 is shown, while FIG. 6*b* shows a pig face 72, and FIG. 6*c* shows a bear face 74.

Although preferred embodiments of the invention have been herein illustrated and desctibed, it will be understood that various changes and innovations can be affected in the invention without departure from these basic principles and within the spirit and scope of the invention. All such changes and innovations thus continuing to relay on the basic principles of the invention are therefore deemed to be within the spirit and scope of the invention herein described, except as the invention may be necessarily limited by the appended claims or reasonable equivalents thereof.

What is claimed is:

1. An insert for a nursing bottle combination of the type comprising a nursing bottle having an open end and threads about said bottle at said open end, and a spinner cap for sealing said open end, said spinner cap defining an interior and having threads for mating with the threads of said bottle and a top defining an opening, comprising:

an insert member defining a weaning spout, said insert member being sized for mounting on the open end of said bottle intermediate said bottle and the interior of said spinner cap, and said weaning spout being adapted to extend through the opening in the top of said spinner cap;

a control member sized for mounting on the open end of said bottle adjacent said insert member, said weaning spout defining a fluid passageway having an inlet and an outlet, and said control member having an opening for fluid communication with the fluid passageway in said weaning spout, said inlet including means being alignable with and movable relative to the opening in the control member to vary the size of said inlet and thereby control the flow through the fluid passageway defined by the weaning spout; and said weaning member having a first axially extending connecting portion and said control member having a corresponding second axially extending connection portion, wherein said first axially extending connecting portion and said second axially extending connecting portion include means to facilitate the relative rotation between said control member and weaning member.

2. The insert as set forth in claim 1 wherein said insert is formed so that said weaning spout forms a portion of the face of an animal character.

3. In a nursing bottle combination including a nursing bottle having an open end and threads at said open end, and a cap having a top defining an opening and a flange having threads for mating with the threads of a bottle, the improvement comprising:

an insert member receivable in said cap, said insert member having a weaning spout projecting from the insert member and extending through the opening in the top of the cap, the weaning spout including an opening extending through said insert member:

a control member sized for mounting on the open end of the bottle, said control member having an opening being disposed to be registrable with the opening of the weaning spout, and said opening through said insert member including means for movement with respect to the opening of said control member to vary the size of said inlet and thereby control the rate of fluid flow through the weaning spout; and said weaning member having a first axially extending connecting portion and said control member having a corresponding second axially extending connecting portion, wherein said first axially extending connecting portion and said second axially extending connecting portion include means to facilitate the relative rotation between said control member and weaning member.

4. The combination of claim 3, wherein said first connecting portion comprises an upraised portion projecting from said insert member toward said control member, and said second connecting portion comprises a depression in said control member, said depression receiving said upraised portion.

5. A training device for dispensing fluid from a fluid container having a threaded opening for dispensing the fluid contained therein to an infant's mouth, said training device comprising:

a) a flat cylindrical weaning member having a weaning spout extending upwardly from a location off the axis of said weaning member, said weaning spout adapted to be received within the mouth of a feeding infant, said weaning spout having an inlet and a corresponding outlet allowing passage of a fluid from said container to an infant's mouth, said weaning member further having a first axial connecting means; and b) a flat cylindrical fluid control member adapted to be mounted between and in axial alignment with the threaded opening of the container and said weaning member, said control member having an opening extending therethrough located at a point off the axis of said control member, said control member further having a second axial connecting means adapted to be engaged by said first axial connecting means to allow relative rotation of the control member and weaning member about their respective axes, said control member opening including means wherein by rotation of said control member, said control member opening may limit the size of said weaning spout inlet and thereby control the amount of fluid flow from the container to the infant's mouth.

6. The combination as set forth in claim 5 wherein said weaning member and said control member are adapted to fit on the top of said fluid container to be fixed thereon by a spinner top having threads mating with the threads of said threaded opening.

7. The combination as set forth in claim 5, further comprising a cap for the fluid container, the cap having first threads for mating with the threads on said threaded opening, and second threads, said weaning member having threads cooperating with said second threads to connect the weaning member to the cap, and said control member being fixed in the cap so that rotation of the weaning member adjusts fluid flow through said weaning spout.

* * * * *